US007913889B2

(12) United States Patent
Lawrence

(10) Patent No.: US 7,913,889 B2
(45) Date of Patent: Mar. 29, 2011

(54) AUTOMATIC QUICK CLEAR NOSE FOR NAILER

(75) Inventor: Bobby Lynn Lawrence, Palmetto, FL (US)

(73) Assignee: Campbell Hausfeld/Scott Fetzer Company, Harrison, OH (US)

( * ) Notice: Subject to any disclaimer, the term of this patent is extended or adjusted under 35 U.S.C. 154(b) by 47 days.

(21) Appl. No.: 12/507,350

(22) Filed: Jul. 22, 2009

(65) Prior Publication Data

US 2011/0017798 A1 Jan. 27, 2011

(51) Int. Cl.
*B25C 1/04* (2006.01)

(52) U.S. Cl. ..... 227/123; 227/130

(58) Field of Classification Search ..... 227/8, 119, 227/120, 123, 130
See application file for complete search history.

(56) References Cited

U.S. PATENT DOCUMENTS 3,578,231 A * 5/1971 Novak ..... 227/123
3,934,778 A * 1/1976 Males ..... 227/123
4,549,681 A * 10/1985 Yamamoto et al. ..... 227/8
4,641,772 A * 2/1987 Skuthan ..... 227/123
5,238,168 A * 8/1993 Oda ..... 227/123
5,350,103 A * 9/1994 Monacelli ..... 227/8
5,810,239 A * 9/1998 Stich ..... 227/119
5,988,477 A 11/1999 Deieso et al.
6,173,877 B1 1/2001 Wingert
6,786,380 B2 * 9/2004 Driscoll et al. ..... 227/127
7,431,103 B2 10/2008 Schell et al.
7,431,187 B2 10/2008 Tachihara et al.
7,658,309 B2 * 2/2010 Jang ..... 227/123
2008/0017689 A1 1/2008 Simonelli et al.
2008/0041914 A1 2/2008 Simonelli et al.
2008/0048000 A1 2/2008 Simonelli et al.
2008/0110956 A1 5/2008 Cho et al.
2010/0072247 A1 * 3/2010 Cole, Jr. ..... 227/8

* cited by examiner

*Primary Examiner* — Rinaldi I Rada
*Assistant Examiner* — Andrew M Tecco
(74) *Attorney, Agent, or Firm* — Jones Day

(57) ABSTRACT

A fastener driving apparatus includes a motor with an output shaft. The motor is shiftable between a de-energized condition in which it can not be actuated to move the output shaft, and an energized condition in which it can be actuated to move the output shaft. The apparatus further includes a nose and a control device. The nose is shiftable between differently configured conditions, including a first condition for guiding a fastener driven by the output shaft, and a second condition for releasing a fastener that jams when the nose is in the first condition. The control device maintains the nose in the first condition while the motor remains in the energized condition.

9 Claims, 5 Drawing Sheets

AUTOMATIC QUICK CLEAR NOSE FOR NAILER

TECHNICAL FIELD

This technology relates to a tool for driving fasteners such as nails or staples.

BACKGROUND

A pneumatic tool for driving fasteners has a piston/cylinder assembly with a driver blade. The tool further has a nose configured as a barrel through which the driver blade drives the fasteners. A fastener may sometimes become jammed in the nose.

SUMMARY OF THE INVENTION

A fastener driving apparatus includes a motor with an output shaft. The motor is shiftable between a de-energized condition in which it can not be actuated to move the output shaft, and an energized condition in which it can be actuated to move the output shaft. The apparatus further includes a nose and a control device. The nose is shiftable between differently configured conditions, including a first condition for guiding a fastener driven by the output shaft, and a second condition for releasing a fastener that jams when the nose is in the first condition. The control device maintains the nose in the first condition whenever the motor is in the energized condition.

In a preferred embodiment, the control device shifts the nose to the first condition when the motor is shifted to the energized condition, and shifts the nose back to the second condition when the motor is shifted to the de-energized condition. The motor in the preferred embodiment is a pneumatic motor which is energized by elevated pneumatic pressure. The control device in the preferred embodiment holds the nose in the first condition under the force of elevated pneumatic pressure.

DETAILED DESCRIPTION

Figure 1:
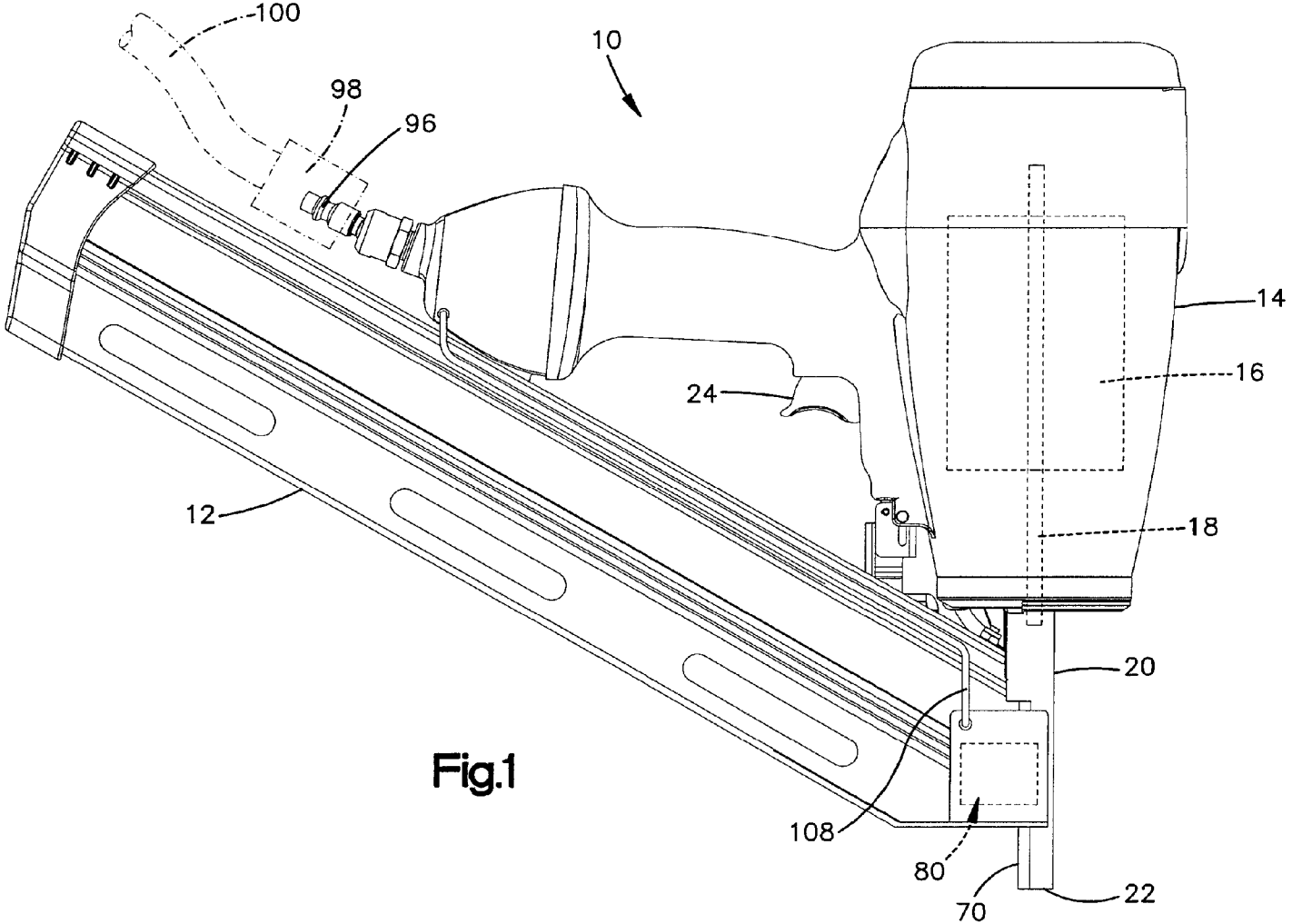
FIG. 1 is a view of a nailer.

The structures shown schematically in the drawings have parts that are examples of the elements recited in the claims. The illustrated structures thus include examples of how a person of ordinary skill in the art can make and use the claimed invention. They are described here to meet the enablement and best mode requirements of the patent statute without imposing limitations that are not recited in the claims.

The tool 10 shown in FIG. 1 is an example of a tool equipped with the claimed invention. This particular tool 10 is a nailer with a nail magazine 12. The nailer 10 has a housing 14 containing a motor in the form of a pneumatic piston/cylinder assembly 16. The piston/cylinder assembly 16 has an output shaft in the form of a driving blade 18. A nose 20 projects forward from the housing 14, and has an open end 22. The nailer 10 further has a trigger assembly 24 for actuating the piston/cylinder assembly 16. When the piston/cylinder assembly 16 is actuated, it advances the driving blade 18 through the nose 20 to drive a nail from the magazine 12 outward through the open end 22.

Figure 2:
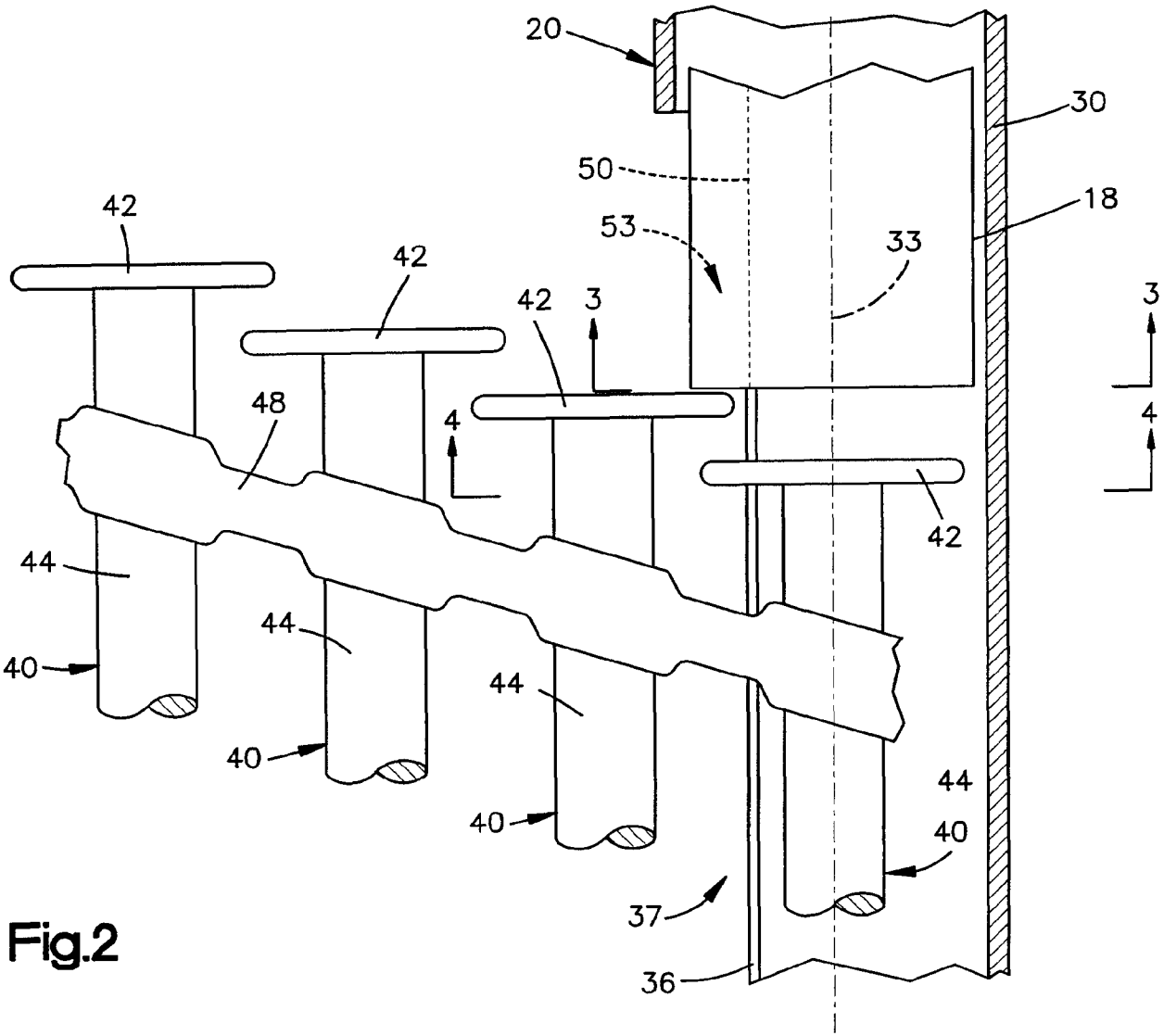
FIG. 2 is a view of parts of the nailer of FIG. 1.
Figure 3:
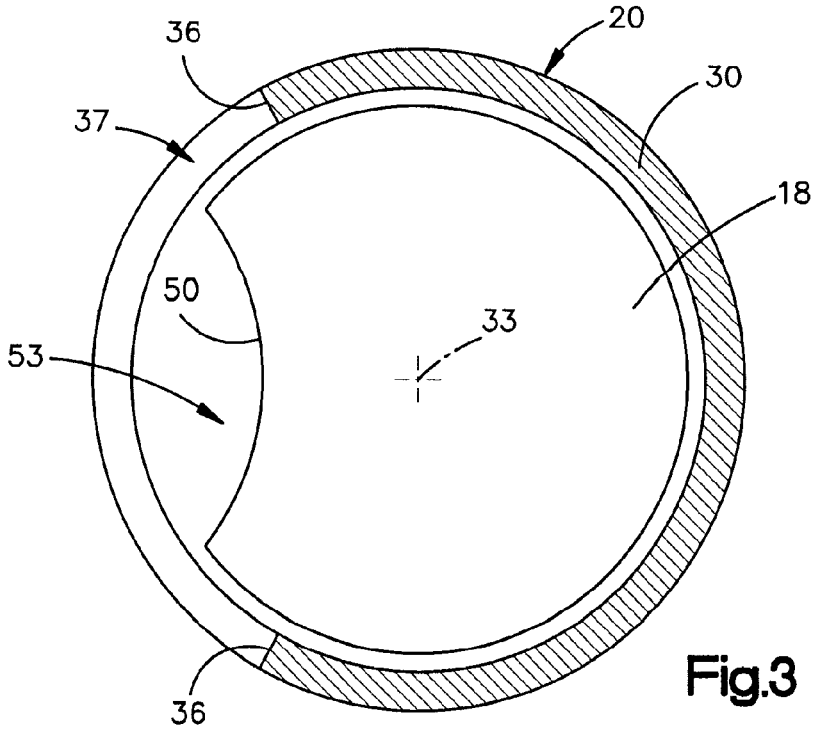
FIG. 3 is a view taken on line 3-3 of FIG. 2.
Figure 4:
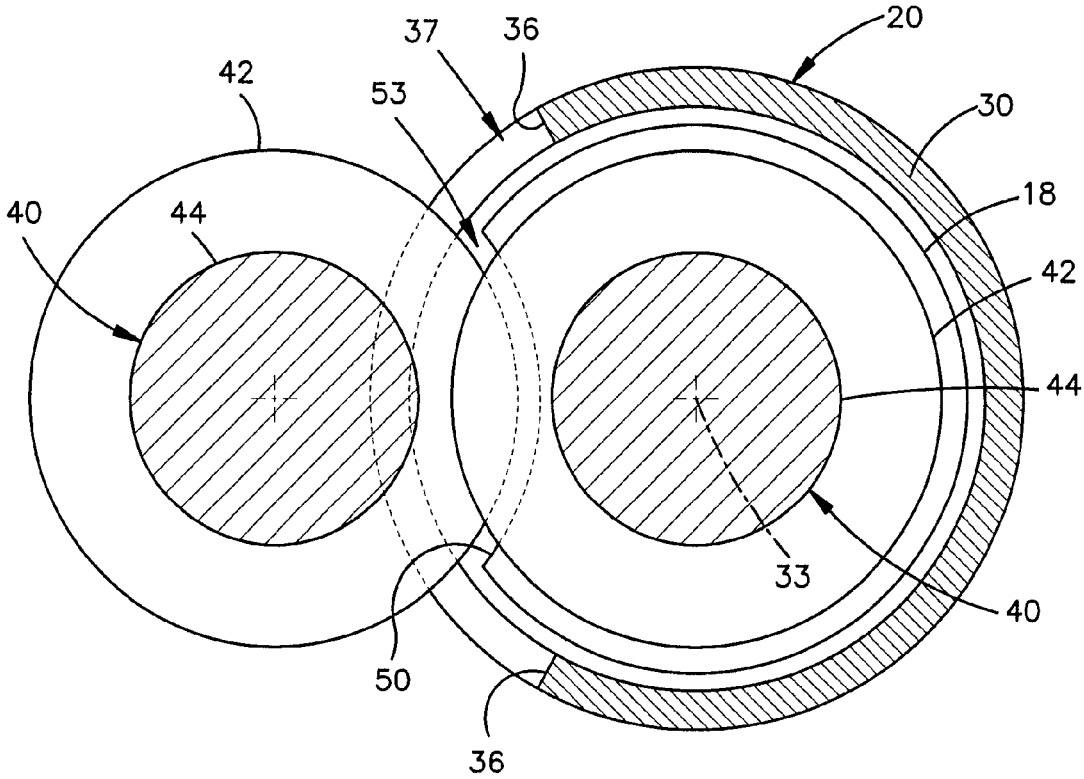
FIG. 4 is a view taken on line 4-4 of FIG. 2.

As shown in FIGS. 2 and 3, the nose 20 includes a cylindrical tube 30 centered on a driving axis 33. The tube 30 has a pair of opposed, circumferentially spaced-apart edge surfaces 36. The edge surfaces 36 extend along the tube 30 in directions parallel to the driving axis 33, and thus define opposite sides of a slot 37 that also extends along the tube 30 parallel to the driving axis 33. The slot 37 extends along the length of the nose 20 past the magazine 12 and onward to the open end 22 (FIG. 1).

As further shown in FIG. 2, the nails 40 in this particular example have circular heads 42 on cylindrical shanks 44. A pair of parallel, frangible plastic strips 48, one of which is shown in FIG. 2, engage the nails 40 at the shanks 44. The plastic strips 48 collate the nails 40 in a row such that each head 42 partially overlaps an adjacent head 42 in the row. The magazine 12 is spring-loaded to advance the nails 40 transversely into the nose 20 through the slot 37.

The driving blade 18 extends into the nose 20 as shown in FIG. 2, and is shaped as shown in FIG. 3. A recessed arcuate edge surface 50 of the driving blade 18 extends along its length. The edge surface 50 defines a groove 53 that interrupts an otherwise cylindrical shape centered on the driving axis 33. The groove 53 in the driving blade 18 is aligned beside the slot 37 in the nose 20.

Figure 5:
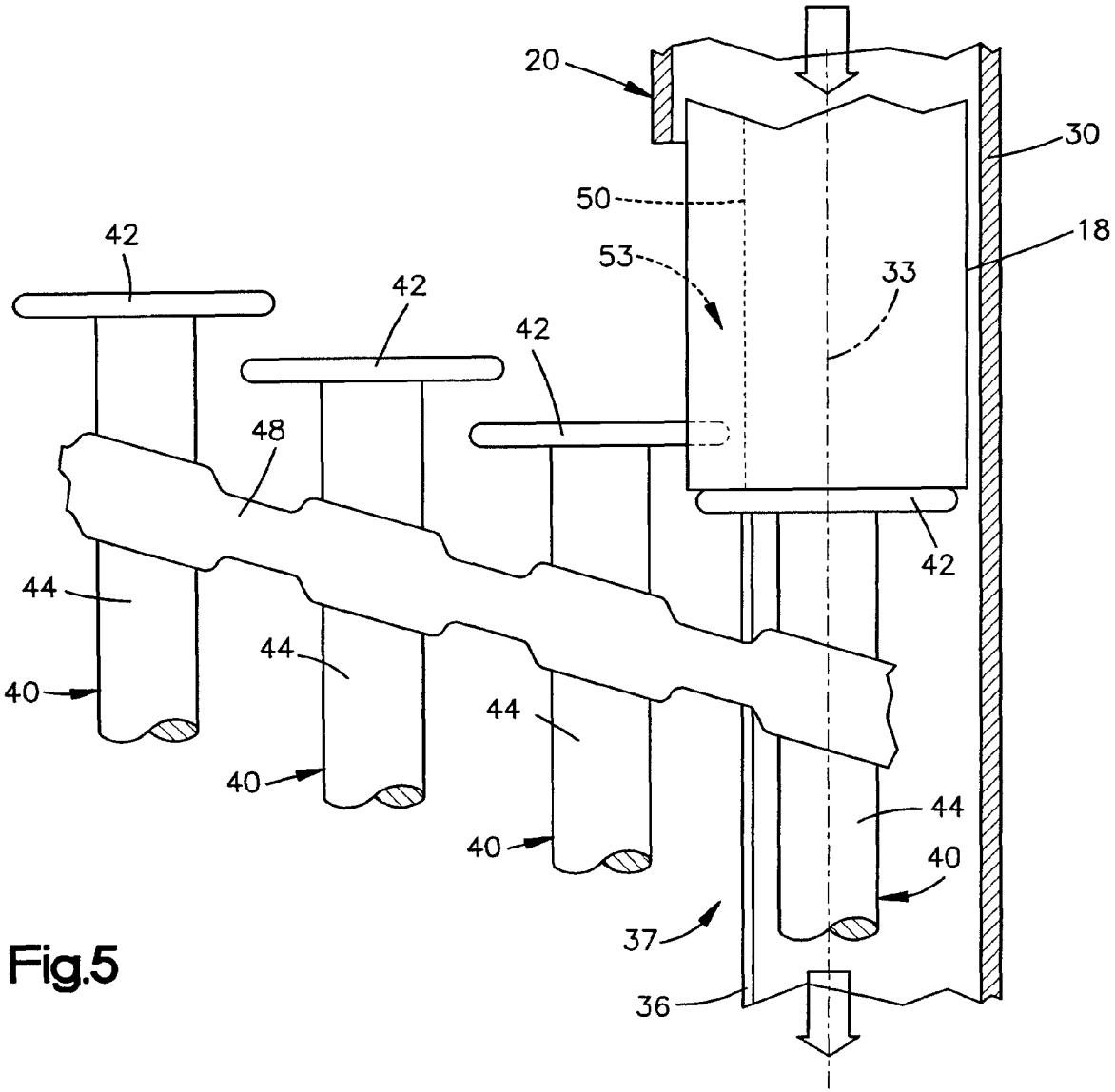
FIG. 5 is a view similar to FIG. 2, showing parts in different positions.

When the piston/cylinder assembly 16 advances the driving blade 18 along the axis 33, it moves the driving blade 18 toward and against the head 42 of the nail 40 to be driven, as shown in FIGS. 2 and 5. The groove 53 provides clearance for the driving blade 18 to move axially past the collated head 42 of the next nail 40, which has then been advanced partly from the magazine 12 into the nose 20 through the slot 37. Further movement of the driving blade 18 forces the head 42 of the driven nail 40 to sever the plastic collating strips 48 and move fully through and outward from the nose 20. The return stroke of the piston/cylinder assembly 16 retracts the driving blade 18 sufficiently for the magazine 12 to advance the next nail 40 into the nose 20 through the slot 37.

It is possible for a nail 40 to become jammed in the nose 20. For this reason the nose 20 is configured as a mechanism that is shiftable between first and second conditions. When in the first condition, the nose 20 is configured to guide a nail 40 along the driving axis 33 and outward from the open end 22 under the influence of the driving blade 18. When in the second condition, the nose 20 is configured to release a nail that jams when the nose 20 is in the first condition.

Figure 7:
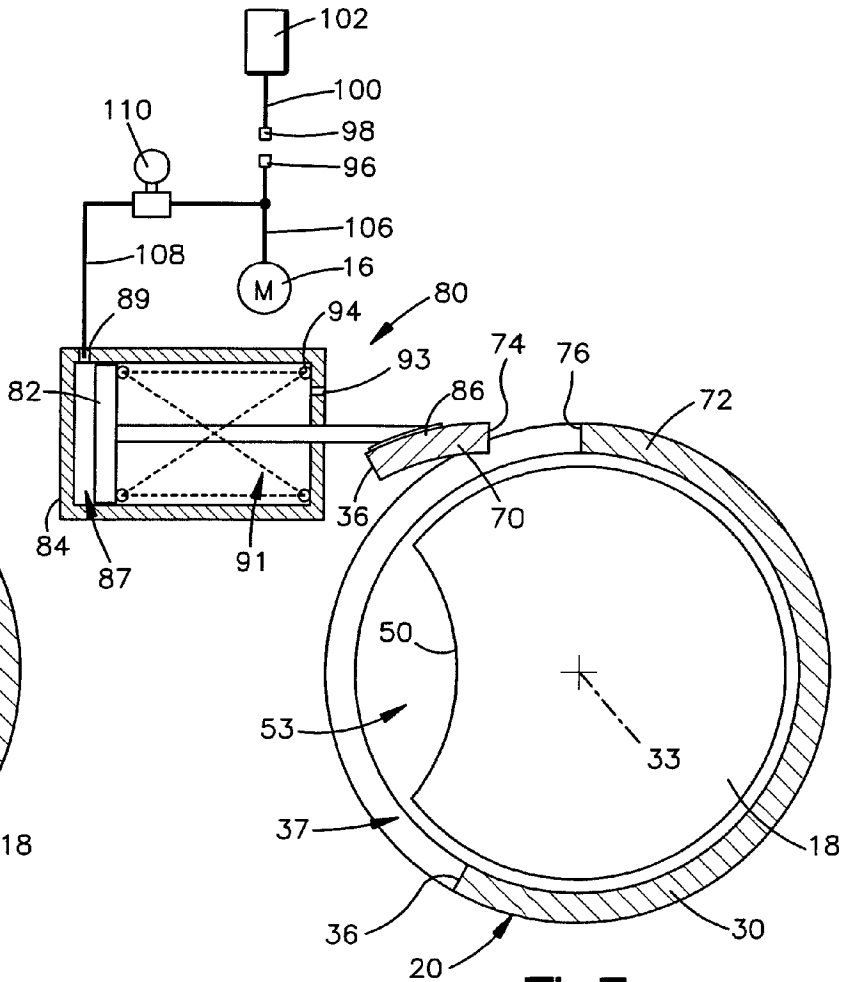
FIG. 7 is a view similar to FIG. 6, showing parts in different positions.
Figure 6:
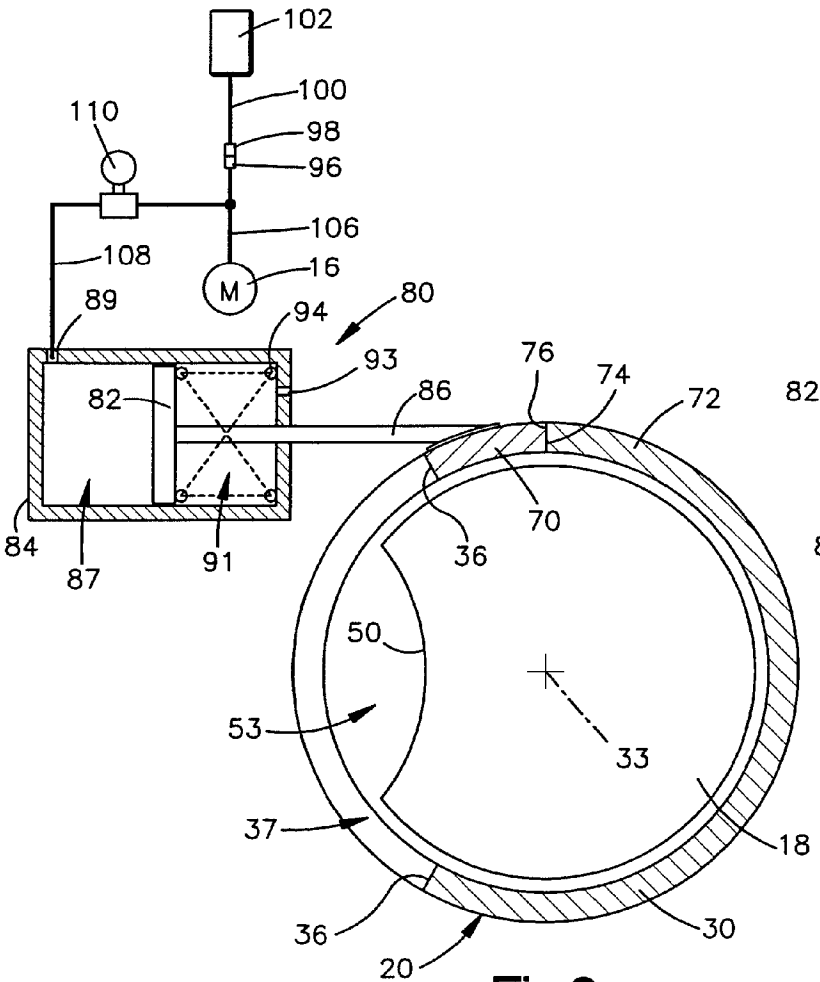
FIG. 6 is a view similar to FIG. 3, showing additional parts of the nailer.

In the preferred embodiment, the nose 20 includes a door 70 (FIGS. 6 and 7). When the door 70 is in the closed position shown in FIG. 6, the nose 20 is in the first condition for guiding a nail 40 along the driving axis 33. When the door 70 is in the open position shown in FIG. 7, the nose 20 is in the second condition for releasing a jammed nail 40.

In this particular example, the door 70 is a separate arcuate section of the slotted cylindrical tube 30. The door 70 and another arcuate section 72 fit together to form the circular cross-section of the tube 30. Specifically, the door 70 includes one of the edge surfaces 36 beside the slot 37, and has an inner edge surface 74 remote from the slot 37. In the closed position of FIG. 6, the inner edge surface 74 of the door 70 abuts, or is located closely adjacent to, an opposed edge surface 76 of the other section 72 of the tube 30. The closed door 70 is thus included in the configuration of the nose 20 that closely surrounds a nail head 42 to guide the nail 40 along the driving axis 33.

In the open position of FIG. 7, the door 70 is spaced from the other section of the 72 of the tube 30. This enlarges the cross-sectional area surrounded by the two sections 70 and 72 of the tube 30, and also enlarges the slot 37. Those dimensions of the nose 20 are enlarged sufficiently to provide clearance for a jammed nail 40 to fall or be removed manually from the tube 30 either axially outward through the open end 22 or transversely outward through the slot 37.

As further shown in FIGS. 6 and 7, the nailer 10 is equipped with a control device to shift the nose 20 between the first and second conditions. The preferred embodiment of the control device is a single acting pneumatic piston/cylinder assembly 80 including a piston 82, a cylinder 84, and an output shaft 86. The cylinder 84 has a variable volume pneumatic pressure chamber 87 with a port 89 on one side of the piston 82, and has a chamber 91 with a vent 93 on the other side of the piston 82. A spring 94 in the vented chamber 91 acts directly on the piston 82 to bias the piston 82 toward the pressure chamber 87. The output shaft 86 is linked to the door 70.

Referring again to FIG. 1, the nailer 10 includes a pneumatic coupling 96. As shown schematically in FIGS. 1, 6 and 7, the nailer coupling 96 connects to a source coupling 98 on a pneumatic pressure line 100 that extends from a compressor 102 or other source of elevated pneumatic pressure for powering the piston/cylinder assembly 16. The nailer 10 further includes a pneumatic working pressure line 106 communicating the nailer coupling 96 with the piston/cylinder assembly 16, and a pneumatic control pressure line 108 communicating the nailer coupling 96 with the cylinder 84 in parallel with the piston/cylinder assembly 16. A pressure regulator 110 may be included to reduce the pressure transmitted to the cylinder 84.

In operation of the nailer 10, the user connects the nailer coupling 96 to the source coupling 98 to transmit elevated pneumatic pressure to the piston/cylinder assembly 16 through the working pressure line 106. The control pressure line 108 simultaneously transmits elevated pneumatic pressure from the nailer coupling 96 to the cylinder 84. This pressurizes the pressure chamber 87 to move the piston 82 in a forward stroke, which is from left to right as viewed in FIG. 6, against the bias of the spring 94. The output shaft 86 then moves the door 70 to the closed position, and continues to hold the door 70 in the closed position as long as the pressure chamber 87 remains pressurized to hold the piston 82 in the position of FIG. 6. The nose 20 will thus remain in the first condition for ejecting driven nails 40 as long as the nailer coupling 96 continues to receive elevated pneumatic pressure from the source 102. This ensures that the door 70 will be in the closed position whenever the piston/cylinder assembly 16 is energized with elevated pneumatic pressure from the source 102, and thus provides a safety feature by ensuring that the door 70 will be in the closed position whenever the user actuates the piston/cylinder assembly 16 to advance the driving blade 18 through the nose 20.

If a nail 40 becomes jammed in the nose 20, the user can shift the nose 20 from the first condition to the second condition by turning off the compressor 102 and bleeding the air from the line 100 or by disconnecting the nailer coupling 96 from the source coupling 98. The pressure chamber 87 then returns to atmospheric pressure by venting through the port 89 to the control pressure line 108. As the pressure chamber 87 vents, the spring 94 moves the piston 82 through a return stroke in which the output shaft 86 moves the door 70 to the open position. This frees a jammed nail, and provides an additional safety feature by ensuring that the piston/cylinder assembly 16 is de-energized whenever the door 70 is open for a user to manually remove a jammed nail 40.

This written description sets forth the best mode of carrying out the invention, and describes the invention so as to enable a person skilled in the art to make and use the invention, by presenting examples of elements recited in the claims. The patentable scope of the invention is defined by the claims, and may include other examples that occur to those skilled in the art. Such other examples, which may be available either before or after the application filing date, are intended to be within the scope of the claims if they have structural elements that do not differ from the literal language of the claims, or if they have equivalent structural elements with insubstantial differences from the literal language of the claims.

The invention claimed is:

1. A fastener driving apparatus comprising:

a pneumatic motor with an output shaft configured to drive a fastener;

a nose configured to eject a fastener, the nose including a door having a closed position to guide a fastener driven by the output shaft and an open position permitting a jammed fastener to be removed from the nose;

a piston/cylinder assembly including a variable volume pneumatic pressure chamber with a port, a piston linked to the door so as to move the door into the closed position under the force of pressure in the chamber, and a spring biasing the piston against the force of pressure in the chamber;

a coupling configured to receive elevated pneumatic pressure; and a pneumatic line communicating the coupling with the port to pressurize the chamber when the coupling receives elevated pneumatic pressure and to vent the chamber when the coupling does not receive elevated pneumatic pressure.

2. A fastener driving device as defined in claim 1 wherein the piston is linked to the door so as to move the door toward the open position under the influence of the spring.

3. A fastener driving apparatus as defined in claim 1 wherein the nose has a slot configured to receive fasteners advanced transversely into the nose through the slot, and the door adjoins the slot when in the closed position.

4. A fastener driving apparatus as defined in claim 1 wherein the nose includes a cylindrical tube, and the door includes a separate arcuate section of the cylindrical tube.

5. A fastener driving apparatus as defined in claim 1 wherein the pneumatic line is one of a plurality of pneumatic lines that connect the coupling with the motor and the control device in parallel.

6. A fastener driving apparatus comprising:

a pneumatic motor with an output shaft configured to drive a fastener;

a nose that is shiftable between differently configured conditions, including a first condition for guiding a fastener driven by the output shaft and a second condition for releasing a fastener that jams when the nose is in the first condition;

a control device configured to hold the nose in the first condition under the force of elevated pneumatic pressure;

wherein the control device is configured to hold the nose in the first condition while the elevated pneumatic pressure is being applied to the control device, and to release the nose from being held in the first condition when the applied pressure is relieved; and a spring linked to the nose to shift the nose from the first condition to the second condition when the applied pressure is relieved.

7. A fastener driving apparatus comprising:

a pneumatic motor with an output shaft configured to drive a fastener;

a nose that is shiftable between differently configured conditions, including a first condition for guiding a fastener driven by the output shaft and a second condition for releasing a fastener that jams when the nose is in the first condition; and a control device configured to hold the nose in the first condition under the force of elevated pneumatic pressure;

the control device is configured to shift the nose from the first condition to the second condition; and wherein the control device includes a spring biasing the nose to the second condition.

8. A fastener driving apparatus comprising:

a pneumatic motor with an output shaft configured to drive a fastener;

a nose that is shiftable between differently configured conditions, including a first condition for guiding a fastener driven by the output shaft and a second condition for releasing a fastener that jams when the nose is in the first condition;

a piston arranged to shift the nose to the first condition under the influence of elevated pneumatic pressure moving the piston; and a spring biasing the nose to the second condition.

9. A fastener driving apparatus as defined in claim 8 wherein the spring acts directly on the piston.

* * * * *